US007277067B2

(12) United States Patent
Ko

(10) Patent No.: US 7,277,067 B2
(45) Date of Patent: Oct. 2, 2007

(54) PLASMA DISPLAY PANEL

(75) Inventor: Ji-Sung Ko, Cheonan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 674 days.

(21) Appl. No.: 10/846,702

(22) Filed: May 17, 2004

(65) Prior Publication Data

US 2005/0057444 A1 Mar. 17, 2005

(30) Foreign Application Priority Data

Sep. 1, 2003 (KR) ..... 10-2003-0060762

(51) Int. Cl.
*G09G 3/28* (2006.01)

(52) U.S. Cl. ..... 345/60; 345/37; 345/62; 345/66; 313/567; 313/581; 313/583; 313/590

(58) Field of Classification Search ..... 345/37, 345/60, 62, 66, 71; 313/484, 485, 567, 581, 313/582, 584, 585, 590
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,786,794 A 7/1998 Kishi et al.
5,952,782 A 9/1999 Nanto
RE37,444 E 11/2001 Kanazawa
6,522,071 B1 * 2/2003 Park et al. ..... 313/582
6,630,916 B1 10/2003 Shinoda
RE38,357 E * 12/2003 Amemiya et al. ..... 313/582
6,707,436 B2 3/2004 Setoguchi et al.
2001/0050533 A1 * 12/2001 Hirose ..... 313/583
2002/0005822 A1 * 1/2002 Lee et al. ..... 345/60
2002/0140365 A1 * 10/2002 Kobayashi ..... 315/169.3

(Continued)

FOREIGN PATENT DOCUMENTS

JP 02-148645 6/1990

(Continued)

*Primary Examiner*—Bipin Shalwala
*Assistant Examiner*—Vincent E. Kovalick
(74) *Attorney, Agent, or Firm*—Robert E. Bushnell, Esq.

(57) ABSTRACT

A plasma display panel with an improved sustain electrode structure and capable of enhancing optical efficiency includes: a rear substrate; address electrodes arranged in a predetermined pattern on the rear substrate; a lower dielectric layer arranged to cover the address electrodes; barrier ribs arranged on the lower dielectric layer; phosphors arranged to be applied to internal sections of discharge cells defined by the barrier ribs; a front substrate arranged opposite the rear substrate; sustain electrodes including bus electrodes arranged in a predetermined pattern and transparent electrodes having relatively wider widths than that of the bus electrodes and arranged to extend toward the internal sections of the discharge cells from the bus electrodes, the transparent electrodes including lead-in parts each having a width equal to 0.5 to 1.5 times a thickness of a corresponding barrier rib, the sustain electrodes intersecting with the address electrodes on a lower surface of the front substrate; and an upper dielectric layer arranged to cover the sustain electrodes.

5 Claims, 5 Drawing Sheets

U.S. PATENT DOCUMENTS

| | | | | |
|---|---|---|---|---|
| 2003/0090212 | A1* | 5/2003 | Park et al. | 315/169.1 |

FOREIGN PATENT DOCUMENTS

| | | |
|---|---|---|
| JP | 8-22772 | 1/1996 |
| JP | 2845183 | 10/1998 |
| JP | 2917279 | 4/1999 |
| JP | 2001-043804 | 2/2001 |
| JP | 2001-325888 | 11/2001 |
| KR | 2000-0056886 | 9/2000 |

* cited by examiner

PLASMA DISPLAY PANEL

CLAIM OF PRIORITY

This application makes reference to, incorporates the same herein, and claims all benefits accruing under 35 U.S.C. 35 U.S.C. § 119 from an application for PLASMA DISPLAY PANEL earlier filed in the Korean Intellectual Property Office on 1 Sep. 2003 and there duly assigned Ser. No. 2003-60762.

BACKGROUND OF THE INVENTION

1. Field of the Invention

The present invention relates to a plasma display panel, and more particularly, to a plasma display panel, in which a discharge gas is arranged between two substrates having a plurality of electrodes, a discharge voltage is applied thereto, and phosphors are excited by ultraviolet rays generated by the discharge gas, thereby obtaining a desired image.

2. Description of the Related Art

Plasma display panels are classified into direct current type plasma display panels and alternating current type plasma display panels. In the direct current type plasma display panel, electrodes are exposed to a discharge space so that charged particles move directly between corresponding electrodes. On the contrary, in the alternating current type plasma display panel, at least one electrode is covered with a dielectric layer and a discharge is produced by an electric field of wall charges instead of by the direct movement of charges between the corresponding electrodes.

The plasma display panel is manufactured considering parameters such as brightness, contrast, address voltage, and optical efficiency. Preferably, the plasma display panel is manufactured to have a high optical efficiency, brightness and contrast and a low address voltage.

The magnitude of an address voltage required for an address discharge has an influence on the optical efficiency and the structure of a plasma display panel and also has an influence on selecting materials for forming the plasma display panel, etc. That is, as the address voltage increases, current consumption increases, thereby reducing the optical efficiency, increasing a sputtering phenomenon effecting the lower and upper dielectric layers, and increasing cross-talk in which charged particles move to neighboring discharge cells through the barrier ribs. Accordingly, the address voltage is preferably set to a low level.

However, in conventional plasma display panels, transparent electrodes are formed having the same width in both the discharge areas and non-discharge areas. Accordingly, power consumption inevitably increases due to the unnecessary transparent electrodes formed on the non-discharge areas, which increases the address voltage. Furthermore, since the transparent electrodes formed on the non-discharge areas act as resistors, an aperture ratio of the display panel is lowered.

Conventionally, metal bus electrodes are formed on the lower surfaces of the transparent electrodes to improve the conductivity of the transparent electrodes. However, since additional wiring of the metal bus electrodes are required along with an increased plasma display panel size, the wiring resistance of the metal bus electrodes is not negligible.

The bus electrodes can be formed to have greater widths or can be formed to have greater thicknesses. However, if the bus electrodes are formed to have greater widths, then the brightness is reduced and the size of the discharge cells is reduced since light emission in the discharge areas is limited by the width of the bus electrodes. Alternatively, if the bus electrodes are formed to have greater thicknesses, the processing time needed to form the bus electrodes increases, which increases the processing costs. Furthermore, if the bus electrodes are formed by deposition, then there is a limitation on the maximum thicknesses of the bus electrodes.

The transparent electrodes in the non-discharge areas can be made smaller than the transparent electrodes in the discharge areas. By using this method, the address voltage becomes lower and light emitting efficiency increases somewhat. However, if the size difference between the sustain electrodes exceeds a threshold value, the address voltage increases since the total area of the transparent electrodes capable of collecting wall charges is reduced, thereby reducing the light emitting efficiency.

SUMMARY OF THE INVENTION

The present invention provides a plasma display panel with an improved sustain electrode structure, capable of enhancing brightness and light emitting efficiency without increasing the address voltage.

According to an aspect of the present invention, a plasma display panel is provided comprising: a rear substrate; address electrodes arranged in a predetermined pattern on the rear substrate; a lower dielectric layer arranged to cover the address electrodes; barrier ribs arranged on the lower dielectric layer; phosphors arranged to be applied to internal sections of discharge cells defined by the barrier ribs; a front substrate arranged opposite to the rear substrate; sustain electrodes, including bus electrodes having relatively narrow widths arranged in a predetermined pattern and transparent electrodes having relatively wide widths arranged to extend toward the internal sections of the discharge cells from the bus electrodes, the transparent electrodes including lead-in parts each having a width equal to 0.5 to 1.5 times a thickness of a corresponding barrier rib, the sustain electrodes intersecting with the address electrodes on a lower surface of the front substrate; and an upper dielectric layer arranged to cover the sustain electrodes.

It is preferable that a width of each lead-in part is equal to a thickness of the corresponding barrier rib.

It is also preferable that a central longitudinal axis of each lead-in part corresponds to a central longitudinal axis of the corresponding barrier rib.

BRIEF DESCRIPTION OF THE DRAWINGS

A more completer appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
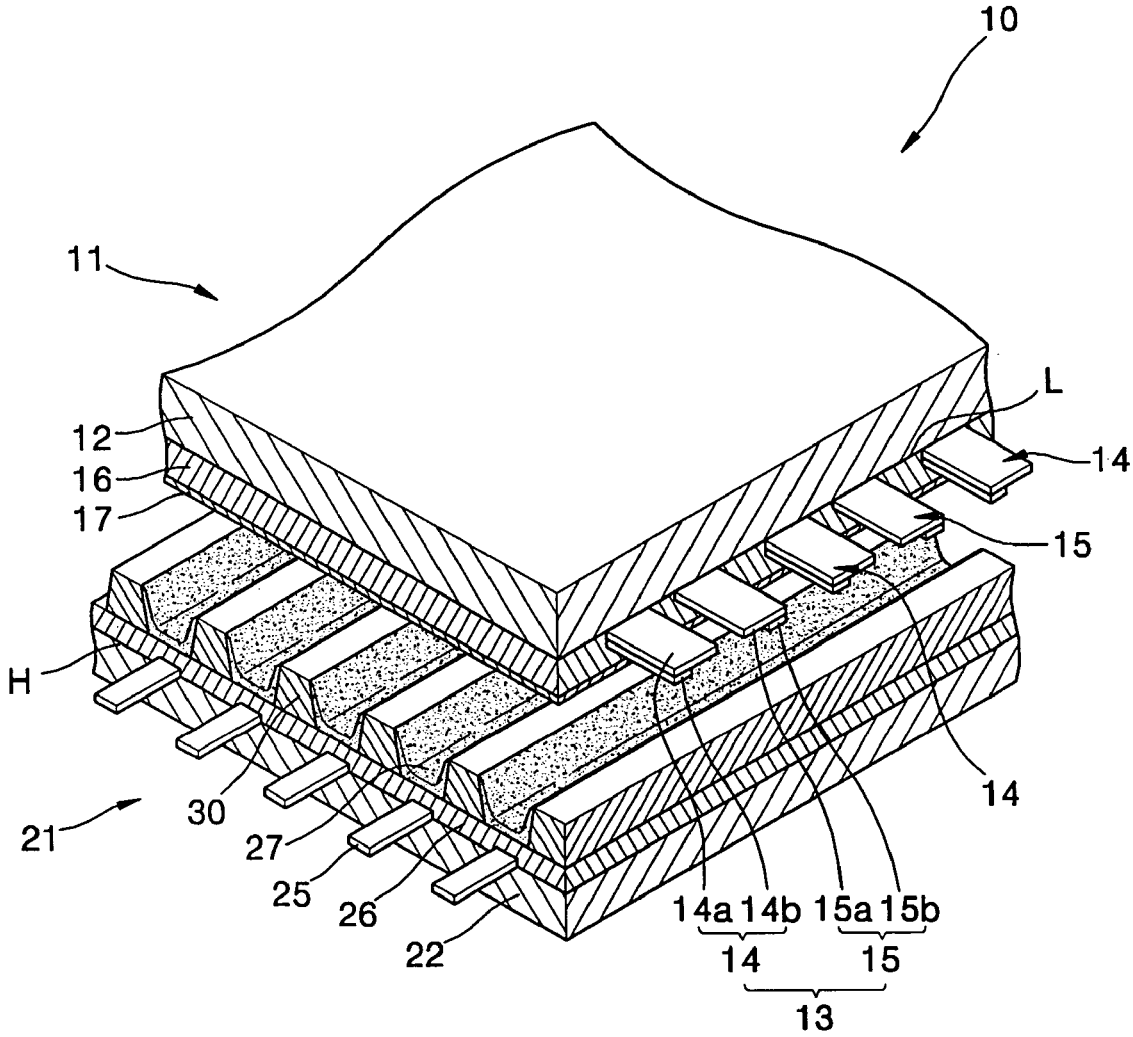
FIG. 1 (PRIOR ART)
FIG. 1 is a perspective view of a conventional plasma display panel.
Figure 2:
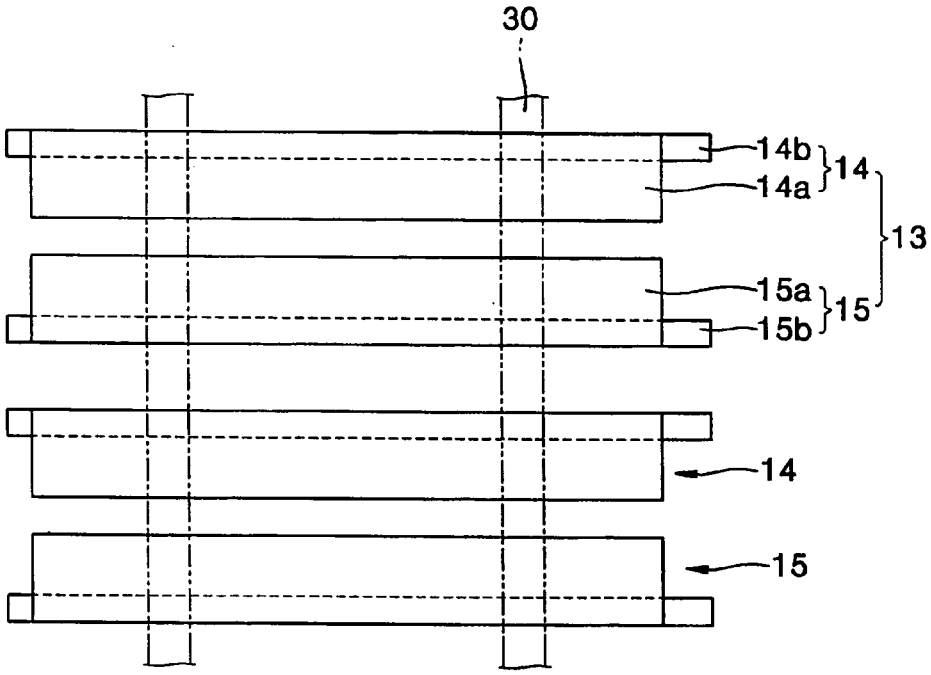
FIG. 2 (PRIOR ART)
FIG. 2 is a view of an arrangement of sustain electrodes and barrier ribs formed on a front substrate of the plasma display panel shown in FIG. 1.

FIG. 1 is a view of a conventional alternating current type plasma display panel and FIG. 2 is a view of an arrangement of sustain electrodes and barrier ribs formed on a front substrate of the plasma display panel shown in FIG. 1. As shown in FIGS. 1 and 2, the conventional plasma display panel 10 includes an upper plate 11 for showing images to a user and a lower plate 21 located opposite to the upper plate.

The upper plate 11 generally includes a front substrate 12, common transparent electrodes 14*a*, and scan transparent electrodes 15*b*. The front substrate 12 may be a glass substrate on whose lower surface L the common transparent electrodes 14*a* and the scan transparent electrodes 15*a* are arranged in pairs. The common transparent electrodes 14*a* and the scan transparent electrodes 15*a* are transparent electrodes formed with ITO (Indium Tin Oxide), and are simply called transparent electrodes.

The lower plate 21 includes a rear substrate 22 and address electrodes 25. The address electrodes 25 are arranged on an upper surface H of the rear substrate 22 located opposite to the front substrate 12 so that the address electrodes 25 intersect with the transparent electrodes 14*a* and 15*a* of the front substrate 12.

An upper dielectric layer 16 and a lower dielectric layer 26 are respectively formed on the lower surface L of the front substrate with the transparent electrodes 14*a* and 15*a* and on the upper surface H of the rear substrate with the address electrodes 25, so as to cover the respective electrodes. A protection layer 17 consisting of MgO is formed on the upper dielectric layer 16, and barrier ribs 30 are formed on the lower dielectric layer 26 in order to ensure discharge distances and prevent electro-optical cross-talk between discharge cells. Red, Green, and Blue Phosphors 27 are applied on both lateral surfaces of the barrier ribs 30 and the upper surfaces of the lower dielectric layer 26 on which no barrier ribs are formed.

Specifically, in the conventional plasma display panel, the transparent electrodes 14*a* and 15*a* have the same size in a discharge area in which a discharge is generated and in a non-discharge area in which no discharge is generated, as shown in FIG. 2.

To drive a plasma display panel with such a structure, an Address and Display period Separated method (ADS) is used to obtain a gray level required for image display by adjusting a sustain discharge count according to video data, dividing one frame into a plurality of sub fields each having a different discharge count, and individually driving the sub-frames in order to represent such a gray level. In the ADS method, each of the sub fields includes a reset period for uniformly generating a discharge, an address period for selecting discharge cells, a sustain period for representing a gray level according to a discharge count, and an elimination period.

Figure 3:
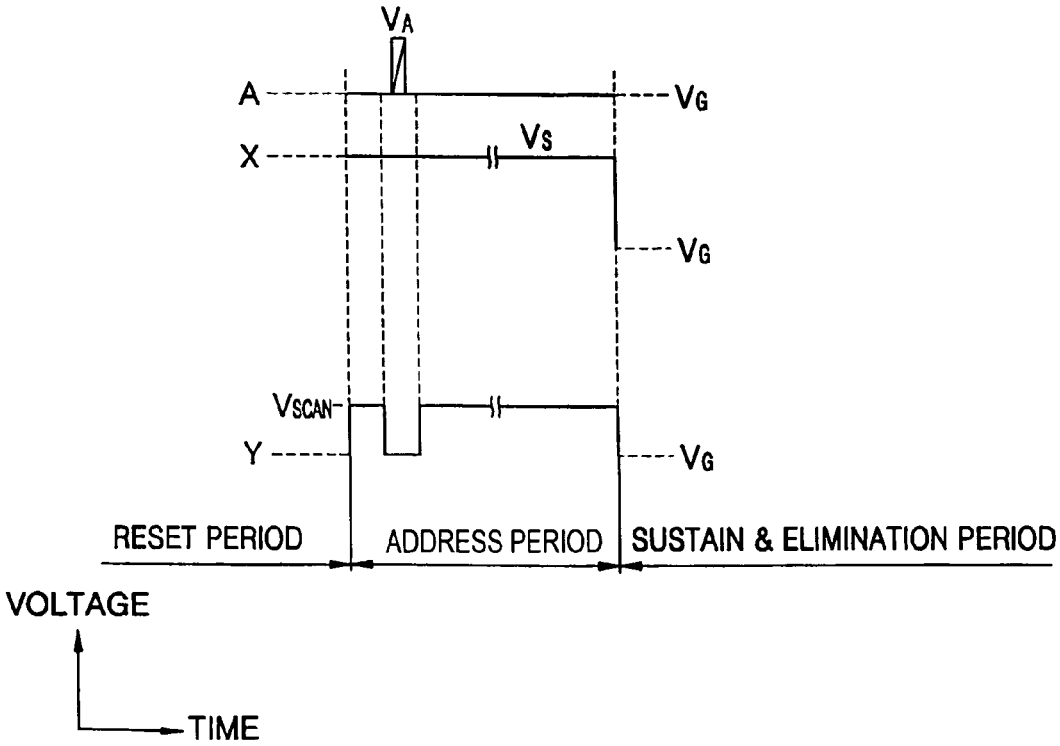
FIG. 3 (PRIOR ART)
FIG. 3 are waveforms of signals applied to electrodes of discharge cells selected to emit light in a plasma display panel during an address period, according to a conventional resetting method.

In the address period, as shown in FIG. 3, an address discharge is generated by a difference between an address voltage $V_A$ applied to an address electrode A arranged in a discharge cell selected to emit light and a ground voltage $V_G$ sequentially applied to the transparent scan electrodes Y. That is, in the address period, all of the transparent scan electrodes Y are biased to a second voltage $V_{SCAN}$ and a scanning signal of the ground voltage $V_G$ is sequentially applied to each discharge cell. Meanwhile, in the address electrode A, a positive polarity address voltage $V_A$ is applied to discharge cells selected to emit light and a ground voltage $V_G$ is applied to discharge cells selected to emit no light. Accordingly, if a display data signal with the positive polarity address voltage $V_A$ is applied while the scanning pulses of the ground voltage $V_G$ are applied, wall charges are formed by an address discharge in the corresponding discharge cells and no wall charges are formed in the other discharge cells. During the address period, in the common transparent electrodes X, a predetermined voltage $V_S$ is maintained to effect a more efficient discharge.

The magnitude of the address voltage $V_A$ required for an address discharge has an influence on the optical efficiency and the structure of the plasma display panel and also has an influence on selecting materials for forming the plasma display panel, etc. That is, as the address voltage $V_A$ increases, current consumption increases, thereby reducing the optical efficiency, increasing a sputtering phenomenon caused on the lower dielectric layer and the upper dielectric layer, and increasing cross-talk in which charged particles move to neighboring discharge cells through the barrier ribs. Accordingly, the address voltage $V_A$ is preferably set low.

However, in the conventional plasma display panel shown in FIGS. 1 and 2, the transparent electrodes 14*a* and 15*a* are formed with the same width in both the discharge areas and the non-discharge areas. Accordingly, consumption power inevitably increases due to the unnecessary transparent electrodes 14*a* and 15*a* formed on the non-discharge areas, which increases the address voltage. Furthermore, since the transparent electrodes formed on the non-discharge areas act as resistors, an aperture ratio is lowered.

To solve such problems, conventionally, metal bus electrodes 14*b* and 15*b* are respectively formed on the lower surfaces of the transparent electrodes 14*a* and 15*a*. Therefore, the conductivity of the transparent electrodes is improved. However, since longer wiring of the metal bus electrodes along with size increase of the plasma display panel, the metal bus electrodes' own wiring resistance is not negligible.

To solve such a problem, the bus electrodes 14*b* and 15*b* can be formed to have greater widths or can be formed to have greater thicknesses. However, if the bus electrodes are formed to have greater widths, the brightness is reduced and the size of the discharge cells are reduced since light emission in the discharge areas is limited by the widths of the bus electrodes. Also, if the bus electrodes are formed to have greater thicknesses, the processing time needed to form the bus electrodes increases, which increases processing costs. Also, in the case where the bus electrodes are formed by deposition, the bus electrodes have a limitation on their maximum thickness.

Figure 4:
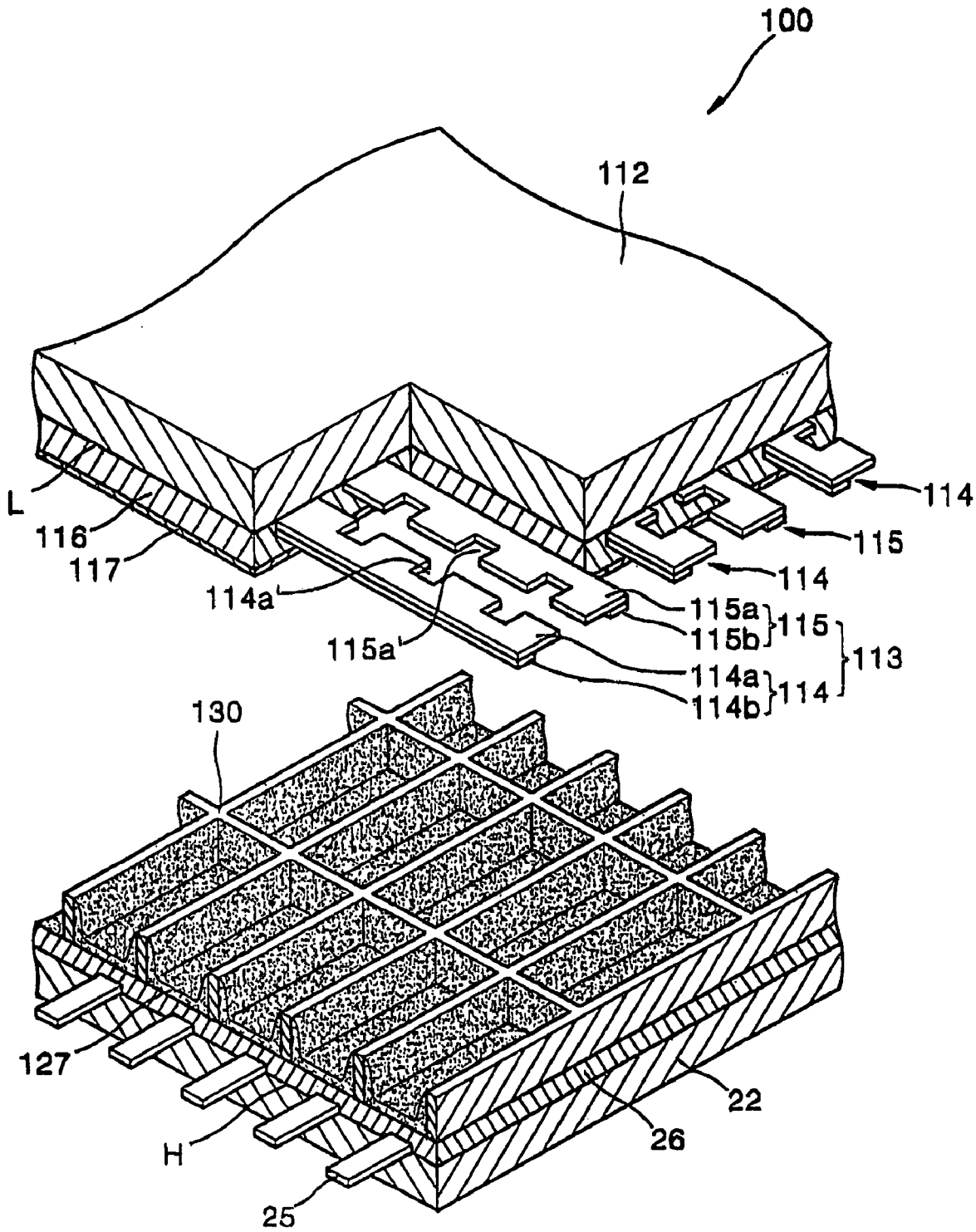
FIG. 4 is a perspective view of a plasma display panel according to an embodiment of the present invention.

FIG. 4 is a perspective view of a plasma display panel according to an embodiment of the present invention. Referring to FIG. 4, the plasma display panel includes a front substrate 112 and a rear substrate 22. The lower portion of the front substrate 112 includes a plurality of transparent electrodes 114*a* and 115*a*, a plurality of bus electrodes 114*b* and 115*b*, and an upper dielectric layer 116. The upper portion of the rear substrate 22 which is located opposite to the front substrate includes address electrodes 25, a lower dielectric layer 26, phosphors 127, and barrier ribs 130. The plasma display panel may include a protection layer 117 as shown in FIG. 4.

The transparent electrodes 114*a* and 115*a* and the bus electrodes 114*b* and 115*b* are formed on the lower surface L of the front substrate 112. The transparent electrodes 114*a* and 115*a* are arranged so as to scan transparent electrodes 115*a* which generates an address discharge with the address electrode 25 and common transparent electrodes 114*a* to which a voltage is applied alternating with the scan transparent electrodes 115*a* and generates a sustain discharge, the electrodes being paired for each discharge cell. Lead-in parts 114*a*' and 115*a*' are formed in predetermined portions of the common transparent electrodes 114*a* and the scan transparent electrodes 115*a*, which correspond to the barrier ribs 130. The common transparent electrodes 114*a* and the scan transparent electrodes 115*a* can be arranged in an order of XYXY as shown in FIG. 4, or in an order of XYYX so that the electrodes are located with an inverse polarity with respect to each other.

The bus electrodes 114*b* and 115*b* are respectively formed on the lower surfaces of the transparent electrodes 114*a* and 115*a*. The bus electrodes 114*b* and 115*b* have narrower widths than the transparent electrodes 114*a* and 115*a*. The X bus electrode 114*b* located on the lower surface of the common transparent electrodes and the Y bus electrode 115*b* located on the lower surface of the scan transparent electrodes can be arranged in pairs in each discharge cell. The bus electrodes compensate for a line resistance of the transparent electrodes.

Hereinafter, the common transparent electrodes 114*a* and the X bus electrode 114*b* with the narrow width formed on the lower surface of the common transparent electrodes 114*a* are referred to as an X electrode 114, and the scan transparent electrodes 115*a* and the Y bus electrode 115*b* with the narrow width formed on the lower surfaces of the scan transparent electrodes 115*a* are referred to as a Y electrode 115. The X electrode 114 and the Y electrode 115 are sustain electrodes, wherein the X electrode 114 and the Y electrode 115 formed in one discharge cell form a sustain electrode pair 113.

The transparent electrodes 114*a* and 115*a* and the bus electrodes 114*b* and 115*b* are covered with an upper dielectric layer 116.

Address electrodes 25 are formed on the upper surface H of the rear substrate so as to intersect with the transparent electrodes and the bus electrodes. The address electrodes 25 are covered with a lower dielectric layer 26. The address electrode 25 and the sustain electrode pair 113 form one discharge cell. The barrier ribs 130, which partition discharge cells, are formed on the lower dielectric layer 26. The phosphors 127 are applied to the internal sections of the discharge cells. In FIG. 4, the barrier ribs 130 are formed in a matrix form. However, the barrier ribs 130 can be formed in a strip form or in a waffle form, etc. The barrier ribs 130 can have a different form other than the above-mentioned forms if they are formed in the non-discharge areas to partition the discharge cells.

To create images in the plasma display panel with the structure described above, a predetermined voltage is applied to the address electrode 25 and the Y electrode 115 to select a discharge cell to emit light, so that address discharge is generated between two electrodes in the discharge cell selected to emit light and wall charges are accumulated on the upper dielectric layer 116. Thereafter, a predetermined voltage is applied between the X electrode 114 and the Y electrode 115 located in the discharge cell, the wall charges move between the two electrodes 114 and 115, which allows a discharge gas to generate a sustain discharge, the discharge gas generates ultraviolet rays, and the generated ultraviolet rays excites the phosphors 127, thereby creating images.

Figure 5:
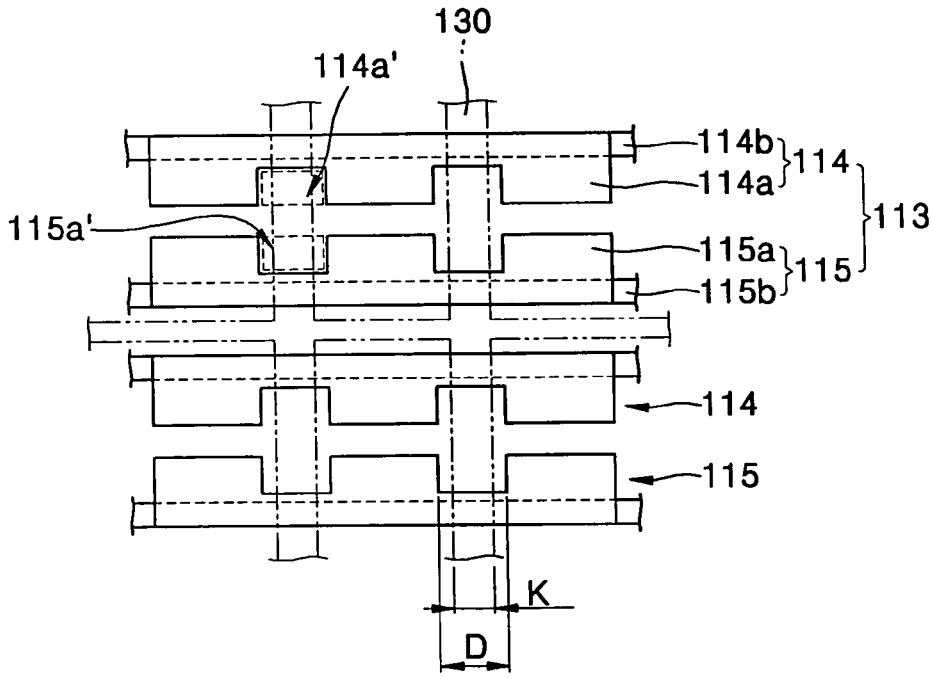
FIG. 5 is a view of an arrangement of sustain electrodes and barrier ribs formed on a front substrate of the plasma display panel shown in FIG. 4.

FIG. 5 is an arrangement of sustain electrodes and barrier ribs formed on a front substrate of the plasma display panel shown in FIG. 4.

Referring to FIG. 5, bus electrodes 114*b* and 115*b* have narrower widths than transparent electrodes 114*a* and 115*a* in a plasma display panel 100 according to an embodiment of the present invention. The transparent electrodes 114*a* and 115*a* with relatively wide widths as compared with the bus electrodes 114*b* and 115*b* are extended in the internal direction of the discharge cell. Lead-in parts 114*a*' and 115*a*' are formed in portions of the transparent electrodes 114*a* and 115*a*, which correspond to non-discharge areas. A discharge area represents the internal area of each discharge cell in which an address discharge is generated between an address electrode 25 and a Y electrode 115 and a sustain discharge is generated between a X electrode 114 and the Y electrode 115, and the non-discharge area represents an area corresponding to the barrier rib 130 in which no discharge is generated, except for the discharge area. The lead-in parts 114*a*' and 115*a*' are formed at the locations corresponding to the barrier ribs 130 and are concave with respect to the other portion of the transparent electrode.

A ratio of a width D of the lead-in part to a thickness K of the barrier rib is an important parameter which determines the address voltage $V_A$, the brightness Lu, and the optical efficiency η e of the plasma display panel. The address voltage $V_A$ is a minimum voltage required for generating an address discharge. Preferably, the address voltage is low and the brightness Lu and the optical efficiency η e are high. Specifically, as the address voltage $V_A$ increases, the optical efficiency is reduced, a sputtering phenomenon which is generated by collisions of charged particles to a dielectric layer on the lower dielectric layer and the upper dielectric layer increases, and cross-talk in which charged particles move to neighboring discharge cells through the barrier ribs and generate wrong discharges, increases. For these reasons, it is preferable for the address voltage $V_A$ of the plasma display panel to be low.

Brightness Lu is defined as a power of visible rays for a unit area, passing through the front substrate. Therefore, it is preferable for the brightness Lu of the plasma display panel to be high. Also, it is preferable for the optical efficiency η e of the plasma display panel to be high. Since the optical efficiency η e is defined as a power of visible rays for an input voltage, passing through the front substrate, the value of the optical efficiency η e generally is proportional to the brightness Lu and is inversely proportional to the address voltage $V_A$.

Figure 6:
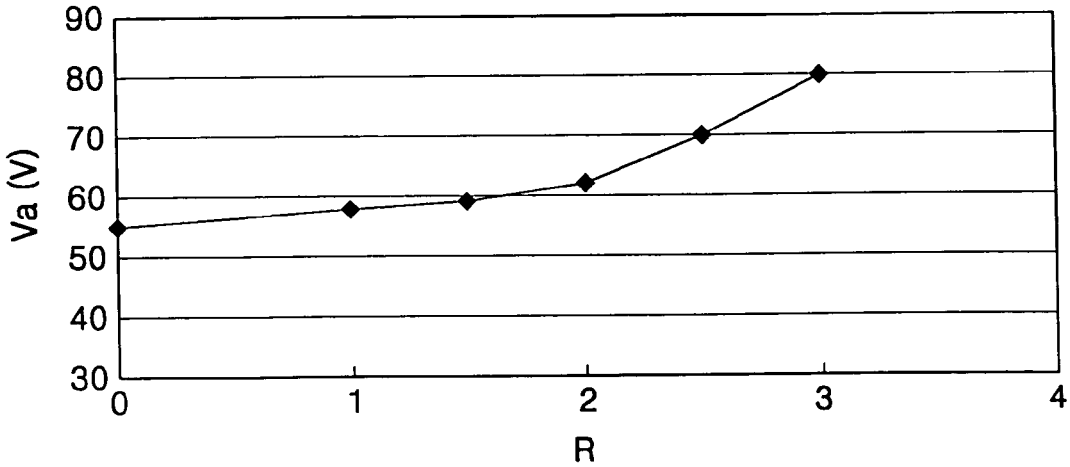
FIG. 6 is a graph of a relationship of an address voltage to a ratio between the width of a lead-in part and the thickness of a corresponding barrier rib shown in FIG. 4.

FIG. 6 is a graph of a relationship of the address voltage $V_A$ to a ratio R (R=D/K) between the width D of the lead-in part of the transparent electrode and the thickness K of a corresponding barrier rib. As illustrated in FIG. 6, as the width D of the lead-in part increases, the address voltage $V_A$ increases gently for a predetermined time, compared with a plasma display panel including scan transparent electrodes without a lead-in part. If the width D of the lead-in part is wider than a predetermined size, the address voltage $V_A$ increases sharply. That is, if the width D of the lead-in part is relatively small, an increased amount of address voltage $V_A$ can be compensated for due to a reduction of the current. However, if the width D of the lead-in part is greater than a predetermined threshold value, the address voltage $V_A$ increases sharply since the total size of the discharge areas is reduced due to the reduction of the cross-section in the lead-in part of the transparent electrodes. Accordingly, as seen in FIG. 6, if a ratio R between the width D of the lead-in part and the thickness K of the corresponding barrier rib is smaller than 1.5, the address voltage $V_A$ increases gently, and if the ratio R reaches 2.0, the address voltage $V_A$ increases sharply.

Figure 7:
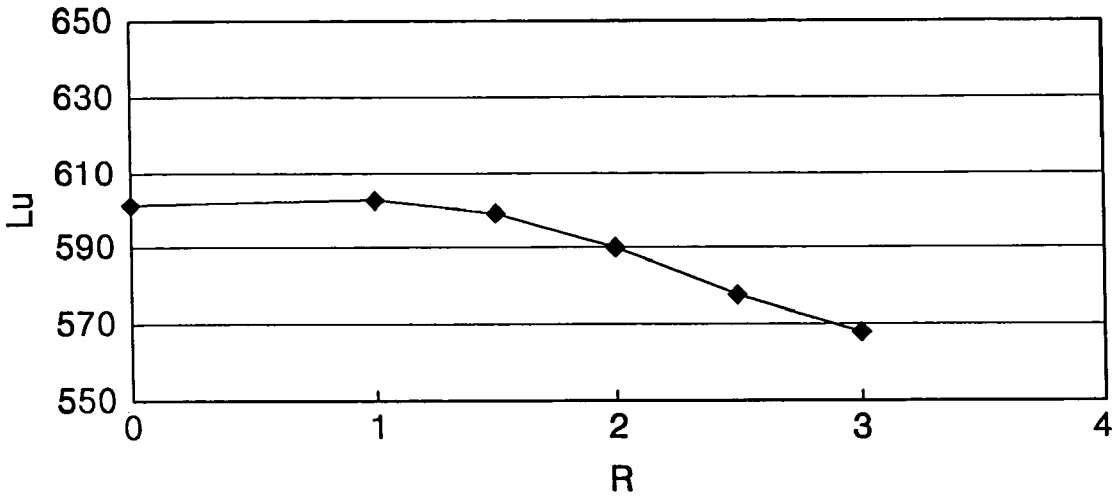
FIG. 7 is a graph of a relationship of brightness to the ratio between the width of the lead-in part and the thickness of the corresponding barrier rib shown in FIG. 4.

FIG. 7 is a graph of a relationship of brightness to the ratio R. As illustrated in FIG. 7, brightness increases slightly until the ratio R reaches 1.0, compared with the case where the ratio R is zero, that is, compared with the case of the transparent electrode without lead-in parts. If the ratio R exceeds 1.0, the brightness decreases slightly, and if the ratio R exceeds 1.5, the brightness decreases greatly. This is because the brightness increases since no transparent electrode acting as a resistor exists if the ratio R is smaller than 1.0, while, brightness decreases since the area of the transparent electrodes generating a sustain discharge is reduced and accordingly the size of the total areas to emit light is reduced if the ratio R exceeds 1.0.

Figure 8:
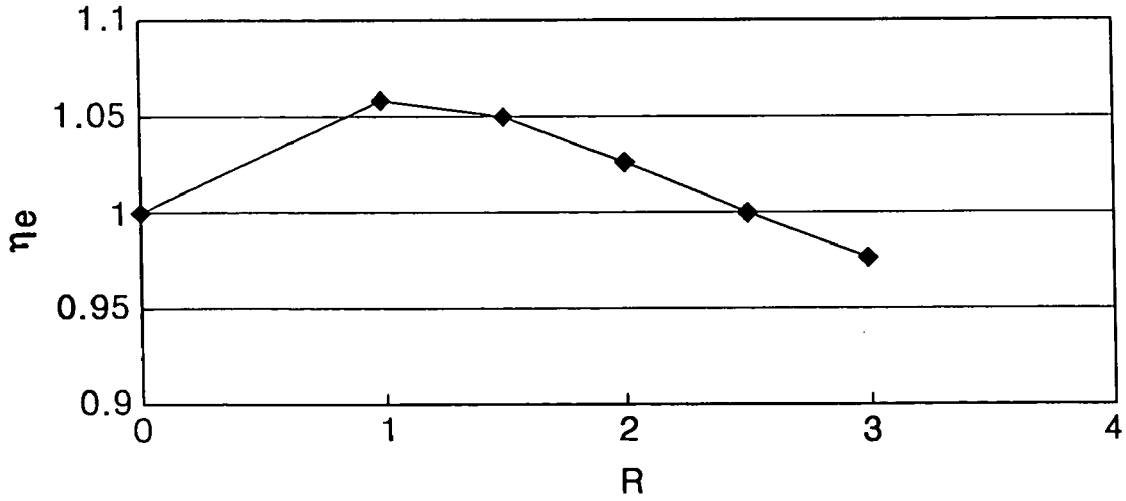
FIG. 8 is a graph of a relationship of optical efficiency to the ratio between the width of the lead-in part and the thickness of the corresponding barrier rib shown in FIG. 4.

FIG. 8 is a graph of a relationship of the optical efficiency to the ratio R. As illustrated in FIG. 8, the optical efficiency increases until the ratio R reaches 1.0 and the optical efficiency decreases if the ratio R exceeds 1.0. As illustrated in FIG. 8, if the ratio R exceeds 1.5, the brightness is lowered with respect to a transparent electrode without lead-in parts. This is because the brightness decreases sharply if the ratio R exceeds 1.5, as shown in FIG. 7, since the optical efficiency is inversely proportional to the address voltage $V_A$ and is proportional to the brightness.

As a result, as seen in FIGS. 6 and 8, if the width D of the lead-in part is 0.5 to 1.5 times the thickness K of the barrier rib corresponding to the lead-in part, the address voltage $V_A$ increases relatively slighty compared with the case of the transparent electrode without lead-in parts. Accordingly, the brightness increases. If the brightness decreases, the decreased deviation of the brightness is small. Accordingly, the optical efficiency increases. Therefore, it is preferable that the width D of the lead-in part of the transparent electrode is equal to 0.5 to 1.5 times the thickness of the corresponding barrier rib in the plasma display panel according to an embodiment the present invention. In particular, the width D of the lead-in part is preferably the same as the thickness K of the corresponding barrier rib, that is, the ratio R equal to 1.0 is preferable. This is because the address voltage $V_A$ is lowest, the brightness is highest, and the optical efficiency is good when the ratio R is 1.0.

Also, it is preferable that the central longitudinal axis of the lead-in part corresponds to the central longitudinal axis of the corresponding barrier rib. This is because the brightness and the optical efficiency are uniformly maintained in neighboring discharge cells when the lead-in parts are formed with the same spacing from the barrier ribs in the neighboring discharge cells.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel comprising:

a rear substrate;

address electrodes arranged in a predetermined pattern on the rear substrate;

a lower dielectric layer arranged to cover the address electrodes;

barrier ribs arranged on the lower dielectric layer;

phosphors arranged to be applied to internal sections of discharge cells defined by the barrier ribs;

a front substrate arranged opposite to the rear substrate;

sustain electrodes, including bus electrodes arranged in a predetermined pattern and transparent electrodes having relatively wider widths than that of the bus electrodes and arranged to extend toward the internal sections of the discharge cells from the bus electrodes, the transparent electrodes including lead-in parts each having a width equal to 0.5 to 1.5 times a thickness of a corresponding barrier rib, the sustain electrodes intersecting with the address electrodes on a lower surface of the front substrate; and an upper dielectric layer arranged to cover the sustain electrodes.

2. The plasma display panel of claim 1, wherein a width of each lead-in part is equal to a thickness of the corresponding barrier rib.

3. The plasma display panel of claim 2, wherein a central longitudinal axis of each lead-in part corresponds to a central longitudinal axis of the corresponding barrier rib.

4. The plasma display panel of claim 1, wherein a central longitudinal axis of each lead-in part corresponds to a central longitudinal axis of the corresponding barrier rib.

5. A plasma display panel comprising:

a rear substrate;

address electrodes arranged in a predetermined pattern on the rear substrate;

a lower dielectric layer arranged to cover the address electrodes;

barrier ribs arranged on the lower dielectric layer;

phosphors arranged to be applied to internal sections of discharge cells defined by the barrier ribs;

a front substrate arranged opposite to the rear substrate;

sustain electrodes, including bus electrodes arranged in a predetermined pattern and transparent electrodes having relatively wider widths than that of the bus electrodes and arranged to extend toward the internal sections of the discharge cells from the bus electrodes, the transparent electrodes including lead-in parts, the sustain electrodes intersecting with the address electrodes on a lower surface of the front substrate; and an upper dielectric layer arranged to cover the sustain electrodes;

wherein a width of each lead-in part is equal to a thickness of the corresponding barrier rib;

and wherein a central longitudinal axis of each lead-in part corresponds to a central longitudinal axis of the corresponding barrier rib.

* * * * *